United States Patent [19]

Kincaid

[11] 4,093,202

[45] June 6, 1978

[54] CABINET DOOR MOUNTING BRACKET

[76] Inventor: John E. Kincaid, 218 Center St., Kernersville, N.C. 27284

[21] Appl. No.: 845,328

[22] Filed: Oct. 25, 1977

[51] Int. Cl.[2] ..... B25B 5/14
[52] U.S. Cl. ..... 269/321 S
[58] Field of Search ..... 269/37, 43, 41, 321 S, 269/246, 45; 248/226.4

[56] References Cited

U.S. PATENT DOCUMENTS

| | | | |
|---|---|---|---|
| 759,560 | 5/1904 | Sharp | 248/226.4 |
| 1,055,937 | 3/1913 | Mitchell | 269/321 S |
| 2,491,638 | 12/1949 | Ayers | 269/321 S |

*Primary Examiner*—Robert C. Watson

[57] ABSTRACT

This invention consists of a bracket for holding cabinet doors or the like while they are being mounted by hinges or other means. The bracket includes adjusting means for aligning the cabinet door as it is being hung.

9 Claims, 4 Drawing Figures

CABINET DOOR MOUNTING BRACKET

BACKGROUND AND OBJECTIVES OF THE INVENTION

Figure 1:
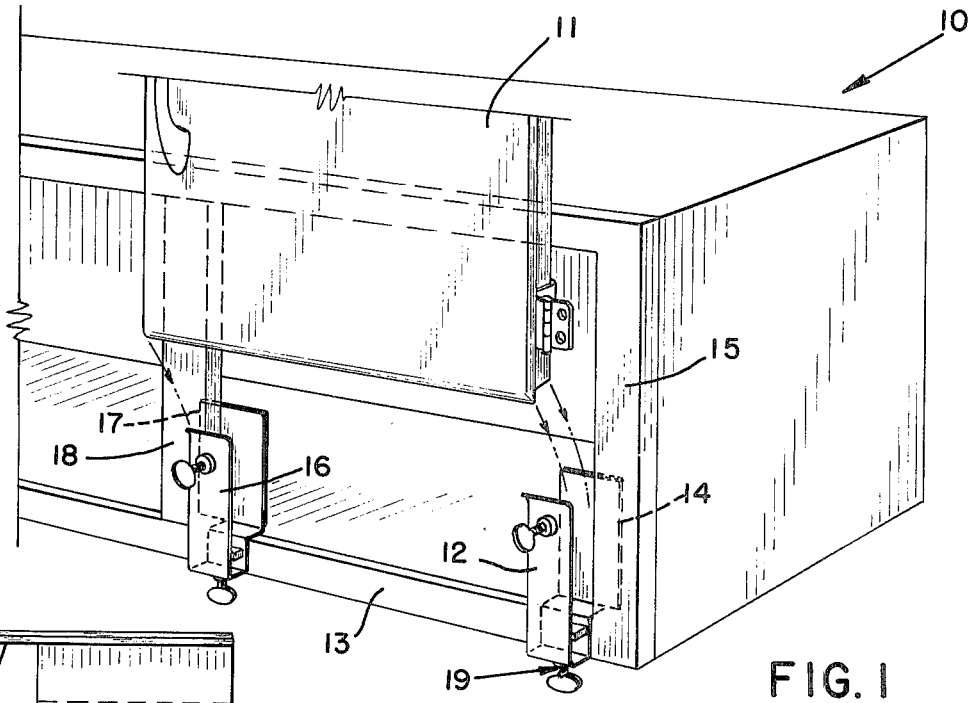

Cabinet makers and carpenters have been continuously plagued with the troublesome task of aligning and hanging cabinet doors in kitchens and elsewhere once the cabinets are constructed and installed. During new construction of buildings or remodeling or refinishing of old structures including homes or apartments, skilled craftsmen are required to perform the arudous task of aligning the cabinet doors and setting the hinges to provide proper operation and neat appearance. Generally, a single carpenter or cabinet maker cannot perform the task alone and a helper is required to assist in aligning the doors during their hanging. Thus, two workers must be employed and oftentimes one worker will be in the way of the other and a high degree of cooperation and teamwork must be developed in order for the men to work efficiently. Also, in confined spaces, it is difficult for two workmen to position themselves advantageously and additional time in performing the work is required which in turn cost the contractor or homeowner additional money.

In some instances, one of the workmen will assume that the other has checked the door for alignment prior to mounting, and to then realize when finished that the door is misaligned. Corrective measures must be taken at that time which are costly and time consuming to properly adjust the door's alignment.

With this background in mind, the present invention was conceived and one of its objectives is to provide a door bracket which will allow an individual carpenter to align and hang cabinet doors without assistance.

It is another objective of the present invention to provide a cabinet door bracket which is easy to construct and inexpensive to manufacture.

It is still another objective of the present invention to provide a cabinet door mounting bracket which will allow proper alignment of the door during mounting.

It is another objective of the present invention to provide a cabinet door mounting bracket which is easily removed after the door is mounted.

It is still another objective of the present invention to provide a cabinet door mounting bracket which will hold the cabinet door firmly and securely during the mounting process.

It is another objective of the present invention to provide a cabinet door mounting bracket which will not injure or marr the cabinet or door when it is being used.

SUMMARY OF THE INVENTION AND DESCRIPTION OF THE DRAWINGS

This present invention consists of a door mounting bracket as may be used by cabinet makers or others for holding and aligning cabinet doors or the like during the "hanging" or mounting process. One or more brackets may be employed, depending on the door and the particular cabinet, and two or more brackets may be slideably connected if it is desirable to do so.

To use the bracket as shown in the preferred embodiment, a right hand bracket (right hand bracket as used herein refers to an upright bracket having a support flange extending toward the right side of the cabinet) is positioned on the bottom cabinet rail with its flange member behind the right stile. Next, a left hand bracket is placed along the bottom rail with its flange extending behind the center stile of a typical cabinet having left and right handed doors. With the brackets so positioned, a cabinet door is then placed into the brackets and its bottom edge is aligned properly with the cabinet by rotating the lower adjusting means affixed to the brackets. The upper adjuster means is turned as required to hold the door firmly against the cabinet during mounting. Thereafter, the hinges are secured to the door and to the cabinet while the door is in proper alignment. Thereafter, the brackets are removed and repositioned for hanging other cabinet doors.

Utilization of the mounting bracket as shown above is merely illustrative of one particular embodiment of the invention and is not intended to depict all the steps of door mounting which are available to the user of the bracket of this invention.

Turning now to the drawings,

FIG. 1 demonstrates a conventional cabinet having two of the novel mounting brackets of the present invention positioned thereon prior to their reception of the cabinet door.

Figure 2:
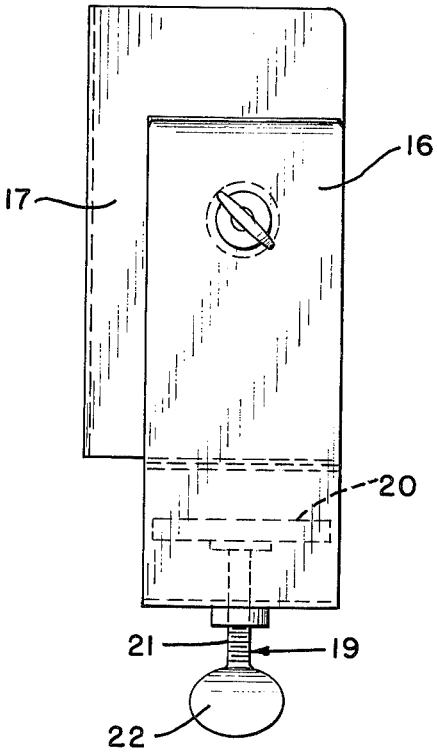

FIG. 2 demonstrates a front elevational view of a left handed bracket of the preferred embodiment.

Figure 3:
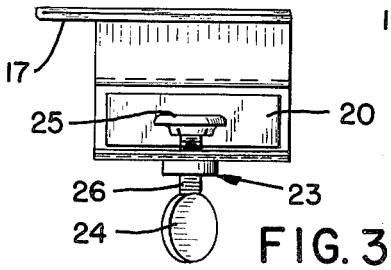

FIG. 3 shows a top view of the bracket as shown in FIG. 2.

Figure 4:
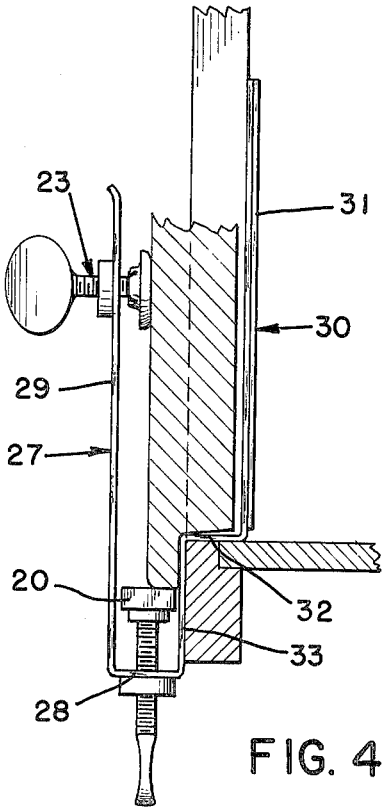

FIG. 4 demonstrates a side elevational view of the bracket as shown in FIG. 2 with a fragmented door contained therein.

For a more detailed description of the drawings, a typical cabinet 10 is shown in FIG. 1 prior to mounting door 11 (shown in fragmented fashion). Right hand bracket 12 is shown positioned on lower rail member 13 with flange member 14 situated behind right stile 15. Also shown positioned on lower rail 13 is left hand bracket 16 with its left support flange 17 positioned behind center stile 18.

As shown in FIG. 2 lower adjusting means 19 can be rotated to raise or lower seat member 20 to raise or lower the vertical height of the door resting thereupon. Seat member 20 pivots on threaded shaft 21 and does not turn as thumb plate 22 is rotated since it is not rigidly connected thereto.

In FIG. 3, upper adjusting means 23 is shown which is part of the preferred embodiment to aid in maintaining the cabinet door in correct vertical alignment against the cabinet front as it is being hung. Rotation of upper adjusting means 23 by thumb plate 24 allows the user to adjust the alignment of the door against the cabinet while it is being hung to hold it firmly in place. As shown in FIG. 3, upper adjusting means 23 includes a threaded shaft, however, a tension member could be employed in place of the threaded adjustment means by one skilled in the art.

Contacting member 25 is pivotably secured to threaded shaft 26 to prevent marring or damaging the cabinet door surface when thumb plate 24 is rotated. Additional precautions may be taken to prevent damage to the cabinet door. For example covering contacting member 25 with a vinyl or other flexible material will aid in preventing surface damage, and the entire bracket may be so treated or covered.

The bracket as shown in FIG. 3 is left handed and is shown with a left support flange 17. It may be desirable to construct brackets with both right and left flanges so they can be used on either side of the cabinet should it be so desired, though pairs of brackets with a single flange have been found to be satisfactory. Also, it may be desirable to eliminate the adjusting means 23 in some embodiments should a more inexpensive construction of the bracket be required.

As shown in FIG. 4, the bracket is constructed of a first L-shaped section 27 having foot portion 28 and leg portion 29. Facing the first L-shaped section is a second L-shaped section 30 being composed of leg portion 31 to which a support flange is attached and foot portion 32. The first and second L-shaped sections are joined in face to face relation to opposite ends on opposite sides of vertical member 33 to thereby form the bracket whereby the leg portions of the first and second L-shaped sections and the vertical member are all substantially parallel. The first and second L-shaped portions may be constructed independently and for example welded together if they are constructed of steel or other suitable metals or the sections may be integrally molded as may be performed in extrusion processes. The bracket may also be formed of a thin metal or plastic and bent to the desired configuration.

It may be desirable to have the first L-shaped section 27 as shown in FIG. 4 pivotally connected to its foot portion 28 with a tension spring (not shown) to provide pressure to the door during alignment, thereby eliminating the need of an upper threaded adjustment means. Other tension means can also be conceived which will work equally well to assist in holding the door stationary during mounting such as a leaf spring or other tension means joined to the nonpivoting leg member 27.

Various modifications and design changes can be conceived by those skilled in the art but such modifications and changes of the bracket are within the scope of the present invention and the examples shown and described herein are not for the purpose of limitation.

I claim:

1. A door holding clamp comprising: a bracket, said bracket having first and second L-shaped sections, said L-shaped sections having leg and foot portions, said first and second L-shaped sections being joined in face-to-face relation to opposite ends on opposide sides of a vertical member, a support flange positioned on said leg portion of one of said L-shaped members and one of said L-shaped members having an adjusting means.

2. A door holding clamp as claimed in claim 1, wherein said vertical member is of a shorter length than said L-shaped member.

3. A door holding clamp as claimed in claim 1, wherein said adjusting means is attached to said foot portion of said L-shaped member.

4. A door holding clamp as claimed in claim 1, wherein said first L-shaped member includes an adjusting means.

5. A door holding clamp as claimed in claim 1, wherein said L-shaped member includes an adjusting means attached to said leg portion of said L-shaped member.

6. A door holding clamp as claimed in claim 1, wherein said first L-shaped member includes an upper adjusting means attached to said leg portion and a lower adjusting means attached to said foot portion.

7. A door holding clamp as claimed in claim 6, wherein said support flange is joined to said second L-shaped member.

8. A door holding clamp as claimed in claim 6, wherein said support flange is joined to the leg portion of said second L-shaped member.

9. A door holding clamp comprising: a bracket, said bracket having first and second L-shaped sections, said L-shaped sections having leg and foot portions, said first and second L-shaped sections being joined by said foot portions in face-to-face relation to opposite ends on opposite sides of a vertical member wherein said leg portions and said vertical member are substantially parallel, and one of said L-shaped members having an adjusting means.

* * * * *